US007479173B2

(12) United States Patent
Ivarsson et al.

(10) Patent No.: US 7,479,173 B2
(45) Date of Patent: Jan. 20, 2009

(54) SUCTION CLEANERS

(75) Inventors: Bengt Ivar Anders Ivarsson, Ma Wan (HK); Reuben Proud, Worcester (GB); Gavin Burnham, Birmingham (GB)

(73) Assignee: Vax Limited, Worcestershire (GB)

( * ) Notice: Subject to any disclaimer, the term of this patent is extended or adjusted under 35 U.S.C. 154(b) by 554 days.

(21) Appl. No.: 11/217,584

(22) Filed: Aug. 31, 2005

(65) Prior Publication Data

US 2006/0107630 A1 May 25, 2006

(30) Foreign Application Priority Data

Sep. 2, 2004 (GB) ..... 0419439.5

(51) Int. Cl.
*B01D 45/12* (2006.01)

(52) U.S. Cl. ..... 55/349; 55/410; 55/429; 55/432; 55/433

(58) Field of Classification Search ..... 55/346, 55/349, 429, DIG. 3, 432, 433, 410; 15/353
See application file for complete search history.

(56) References Cited

U.S. PATENT DOCUMENTS

| | | | |
|---|---|---|---|
| 5,078,761 | A | 1/1992 | Dyson |
| 5,125,127 | A | 6/1992 | Bach et al. |
| 5,135,552 | A | 8/1992 | Weistra |
| 5,351,362 | A | 10/1994 | Kramer et al. |
| 5,500,979 | A | 3/1996 | Wörwag |
| 5,960,514 | A | 10/1999 | Miller et al. |
| 6,058,559 | A | 5/2000 | Yoshimi et al. |
| 6,350,292 | B1 | 2/2002 | Lee et al. |
| 6,572,668 | B1 | 6/2003 | An et al. |
| 6,662,403 | B2 | 12/2003 | Oh |
| 7,329,294 | B2 * | 2/2008 | Conrad ..... 55/319 |
| 2002/0011053 | A1 | 1/2002 | Oh |
| 2002/0062632 | A1 | 5/2002 | Oh |
| 2002/0088078 | A1 | 7/2002 | Oh et al. |
| 2002/0120998 | A1 | 9/2002 | Dubos et al. |
| 2002/0124538 | A1 | 9/2002 | Oh et al. |
| 2003/0106182 | A1 | 6/2003 | Lee |
| 2003/0106183 | A1 | 6/2003 | Frederick et al. |

FOREIGN PATENT DOCUMENTS

| | | | |
|---|---|---|---|
| DE | 38 34 686 | C1 | 12/1989 |
| DE | 94 20 797.6 | U1 | 7/1995 |
| DE | 299 00 460 | U1 | 8/2000 |
| DE | 199 14 574 | C1 | 11/2000 |

(Continued)

OTHER PUBLICATIONS

Pending U.S. Appl. No. 11/187,414, filed Jul. 22, 2005, 23 pages.

(Continued)

*Primary Examiner*—Robert A Hopkins
(74) *Attorney, Agent, or Firm*—Michael Best & Friedrich LLP

(57) ABSTRACT

A cyclonic separator for a suction cleaner comprises a cyclone body of which at least part is afforded by components which fit together at interfaces extending axially of the cyclone body. The components may also afford air inlet and dust outlet passages, and at least partially define a dust-collecting chamber.

27 Claims, 2 Drawing Sheets

FOREIGN PATENT DOCUMENTS

| | | | |
|---|---|---|---|
| DE | 101 10 771 | A1 | 9/2002 |
| EP | 1 386 573 | A2 | 2/2004 |
| FR | 2 425 227 | | 12/1979 |
| GB | 2 128 075 | A | 4/1984 |
| GB | 2 367 510 | A | 4/2002 |
| WO | WO 98/35602 | A1 | 8/1998 |
| WO | WO 2004/049887 | | 6/2004 |
| WO | WO 2004/049889 | A1 | 6/2004 |
| WO | WO 2004/049890 | A1 | 6/2004 |
| WO | WO 2004/052166 | | 6/2004 |

OTHER PUBLICATIONS

Pending U.S. Appl. No. 29/240,051, filed Oct. 7, 2005, 6 pages.
Pending U.S. Appl. No. 29/240,115, filed Oct. 7, 2005, 6 pages.
Pending U.S. Appl. No. 29/240,116, filed Oct. 7, 2005, 5 pages.
Pending U.S. Appl. No. 29/240,117, filed Oct. 7, 2005, 7 pages.
Pending U.S. Appl. No. 29/240,118, filed Oct. 7, 2005, 7 pages.
Pending U.S. Appl. No. 10/537,537, filed Nov. 10, 2005, 21 pages.
Pending U.S. Appl. No. 10/537,381, filed Nov. 14, 2005, 25 pages.
Pending U.S. Appl. No. 10/537,382, filed Nov. 14, 2005, 33 pages.
Pending U.S. Appl. No. 10/537,481, filed Nov. 14, 2005, 14 pages.
Pending U.S. Appl. No. 11/273,094, filed Nov. 14, 2005, 17 pages.
Pending U.S. Appl. No. 11/329,194, filed Jan. 10, 2006, 23 pages.
Pending U.S. Appl. No. 11/375,722, filed Mar. 15, 2006, 16 pages.

* cited by examiner

SUCTION CLEANERS

DESCRIPTION OF INVENTION

This invention relates to suction cleaners (vacuum cleaners). More particularly, the invention relates to a separator of the type commonly referred to as "cyclonic" for separating contaminants such as dust and other dirt (which will all herein be referred to as "dust") from the flow of air drawn by the cleaner from that which is being cleaned.

In recent years, the use of cyclonic separators in suction cleaners has become well established. A typical such separator includes a cyclone body which may be of cylindrical form or possibly tapering, in whole or in part, having an inlet for the stream of dust-containing air. An outlet for air from the cyclone body leads, usually by way of one or more filters, to a source of suction of the cleaner, i.e. a fan or impeller and a motor for driving it. In many cyclonic separators, the inlet extends tangentially of the cyclone body and the outlet lies on the longitudinal axis of the body. Whatever arrangement is adopted, the effect is to cause the air to swirl rapidly in the cyclone body as it passes from the inlet to the outlet thereof, so that dust carried by the air is separated from the airflow by centrifugal force. Separated dust is collected in either a part of the cyclone body intended for this purpose, possibly separated from the remainder of the body by one or more partitions, baffles or the like, or in an adjacent dust-collecting chamber. A typical suction cleaner may include one or more such cyclonic separators: multiple separators may be connected in series or in parallel with one another (in terms of the flow of air therethrough), or possibly a cleaner may incorporate both series and parallel-connected cyclonic separators.

Because of the way it works, the cyclone body of a separator is predominantly circular as viewed lengthwise of the axis (which will hereafter be referred to as the axis of the body) about which the swirling airflow occurs within it in use. Whether the body be cylindrical or tapering in form, the circular cross-sectional shape will predominate over its axial length (although a completely closed circular cross-section may not apply where there are inlet and outlet passages for airflow and separated dust). Because of this, cyclone bodies have, to the best of the applicant's knowledge, always included principal components which are themselves largely in the form of cylinders or of generally frusto-conical shape, and, if moulded of plastics material, which is most common in current suction cleaners, the principal components have been manufactured using moulding tools of which respective mould parts are moveable relative to one another in a direction lengthwise of the axis of the separator body. In some separators, such principal components take the general form of a "jug" or a tapering "cup". However, such a construction places limitations on the form which the complete separator, together with any associated dust-collection chamber, can assume, possibly requiring a large number of additional components to be provided to make up a complete separator-collector assembly.

It is broadly the object of the present invention to address this limitation of known cyclonic separators.

According to one aspect of the present invention, we provide a cyclonic separator for a suction cleaner, comprising a cyclone body of which at least part is afforded by components which fit together along interfaces extending axially of the cyclone body. At least part of one or more of the interfaces between the components may lie in a plane in which the axis of the cyclone body also lies.

At least one of an air inlet and a dust outlet may be afforded by such components.

The cyclone body may comprise two components, whose interfaces therebetween both at least partially lie in a plane in which the axis of the cyclone body also lies. Thus the two components preferably are of semi-cylindrical or tapering, e.g. semi-frusto-conical, form, or each include semi-cylindrical and/or semi-frusto-conical portions.

By constituting the cyclone body in this way, whose consequence is that each component, if injection moulded of a plastics material, may be manufactured using mould parts which come together in directions transverse to the axis of the cyclone body, much greater freedom is afforded to provide other features in association with the cyclone body parts. For example, a portion or portions which at least partially define a dust-collecting chamber may be provided in association with at least one of the cyclone body components. A portion of portions which at least partially define at least one transversely extending, e.g. tangential, feature such as a passage or passages may be incorporated in at least one of the components.

In particular, the components may together afford a tangential air inlet passage to the cyclone body and a tangential dust-outlet passage therefor. As is conventional in cyclonic separators, such an inlet passage may be at or adjacent one end of the cyclone body and the dust-outlet passage at or adjacent the opposite end of the body.

An air outlet passage for the cyclonic separator, through which air from which dust has been separated leaves the separator to flow to the suction source of the cleaner, may be constituted by a separate component extending axially of the separator from one end of the cyclone body, preferably the end having the inlet passage.

According to another aspect of the invention, we provide an assembly including two cyclonic separators, each according to the first aspect of the invention.

Two separators having respective cyclone bodies may be arranged in end-to-end relationship with one another, preferably with their axes in alignment with one another.

The two cyclone bodies may be disposed with their air inlets at their ends which are adjacent one another and their dust outlets at their ends which are remote from one another. The air outlets may be constituted by an outlet member having respective portions which extend into the two cyclone bodies in opposite directions from the adjacent ends of the cyclone bodies. The outlet member may be a generally T-shaped pipe, with the oppositely-extending portions connecting to an outlet pipe lying between the adjacent ends of the cyclone bodies. The outlet pipe may extend transversely of the axes of the two cyclone bodies, to connect to the source of suction in a cleaner.

There may be an air inlet member providing a branched passage leading to the air inlet passages to the cyclone bodies.

These and other features of the invention will now be described by way of example with reference to the accompanying drawings, of which:

Figure 1:
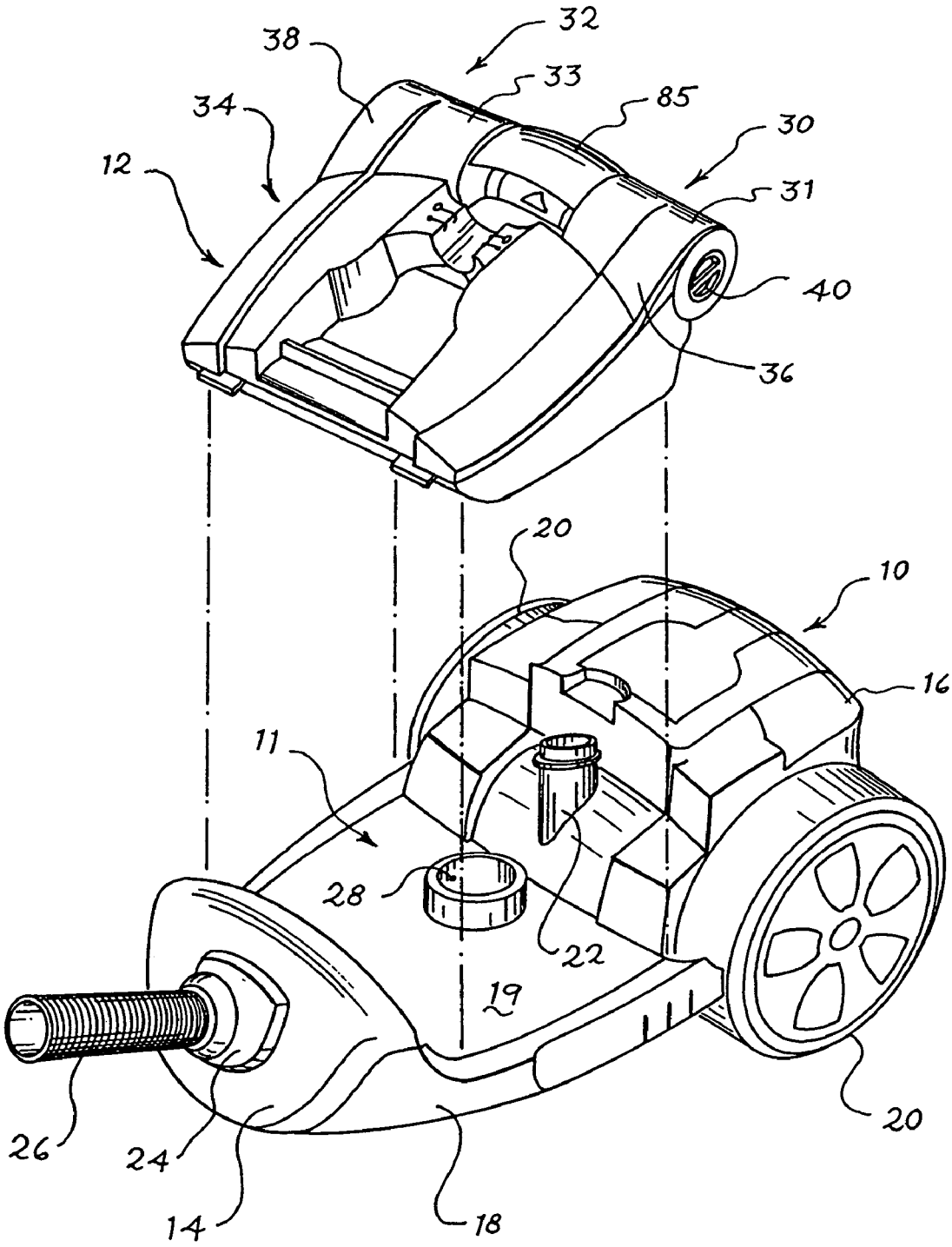
FIG. 1 is a perspective view of a suction cleaner having a separator and dust collector in accordance with the invention, shown detached from the remainder of the cleaner.

Referring firstly to FIG. 1 of the drawings, this shows a suction cleaner having a body indicated generally at 10. The body 10 affords a recess 11 in which a separator and dust collector indicated generally at 12 is accommodated for use. The separator/collector 12 fits vertically into the recess 11, as indicated by the broken lines in FIG. 1.

The recess 11 in the body of the vacuum cleaner is defied between a front portion 14 and a rear portion 16 of the body, and between the portions 14, 16 a portion 18 of the body affords a base 19 of the recess. The rear portion 16 of the body accommodates a source of suction for the cleaner, i.e. an electric motor and a suitable impeller. Wheels 20 by which the cleaner may be moved over a surface on which it is supported are provided one at each side of the rear body portion 16 of the cleaner. The rear body portion 16 also accommodates a pre-motor filter to trap any dust particles remaining in the flow of air leaving the separator/collector 12 of the cleaner, and a post-motor filter for final removal of anything in the flow of air before it is released to the atmosphere. Shown in FIG. 1 is an upwardly-facing tubular spigot 22 whose interior passage leads to the pre-filter. The spigot 22 cooperates with the air exit from the separator/collector assembly, as described hereafter.

The front portion 14 of the cleaner body has a connection 24 for a detachable suction hose 26. The opposite end, not shown, of the hose 26 may be connected to a cleaning tool or cleaning head, possibly by way of a wand, in known manner. Within the front body portion 14 and the portion 18 beneath the recess 11 there is a duct for flow of air from the hose 26, and such duct terminates at an outlet opening 28 facing upwardly towards the centre rear of the bottom of the recess 11. When the separator/collector assembly is in position, this outlet 28 aligns with and connects to a separator inlet member to be described hereafter.

The duct leading from the connector 24 to the outlet 28 may be afforded by a length of extendible hose which can be accommodated when contracted, e.g. in a serpentine configuration, in the body portion 18 beneath the recess 11 and can, when required, be deployed therefrom following release of the connector 24 from the body portion 14. This affords an additional length of hose to that of the suction hose 26, usable when performing cleaning jobs requiring a very long hose. To facilitate easy movement of the cleaner over a surface on which it is supported, a castor wheel or wheels, not shown, may be provided beneath the body 10 of the cleaner towards the front portion 14 thereof or beneath same.

The dust separator/collector assembly 12 includes two cyclonic separator parts 30, 32 and a dust collector chamber 34. The separator parts 30, 32 include respective cyclone bodies 31, 33 which are cylindrical in form and spaced from one another, disposed with their axes (about which swirling of the airflow therein occurs in use) in alignment with one another. In FIG. 1, inlets for dust-laden air to the cyclone bodies 31, 33 are not visible, and neither are outlets for flow of cleaned air therefrom: these are described with reference to FIG. 2. What are visible in FIG. 1 are dust outlet parts 36, 38 extending tangentially from the cyclone bodies at their ends which are remote from one another, the dust outlets leading into the collector chamber 34. The ends of the cyclone bodies 31, 33 adjacent the outlets 36, 38 are closed by respective removable end plugs 40 of which that for the cyclonic separator 30 is clearly visible in FIG. 1.

Figure 2:
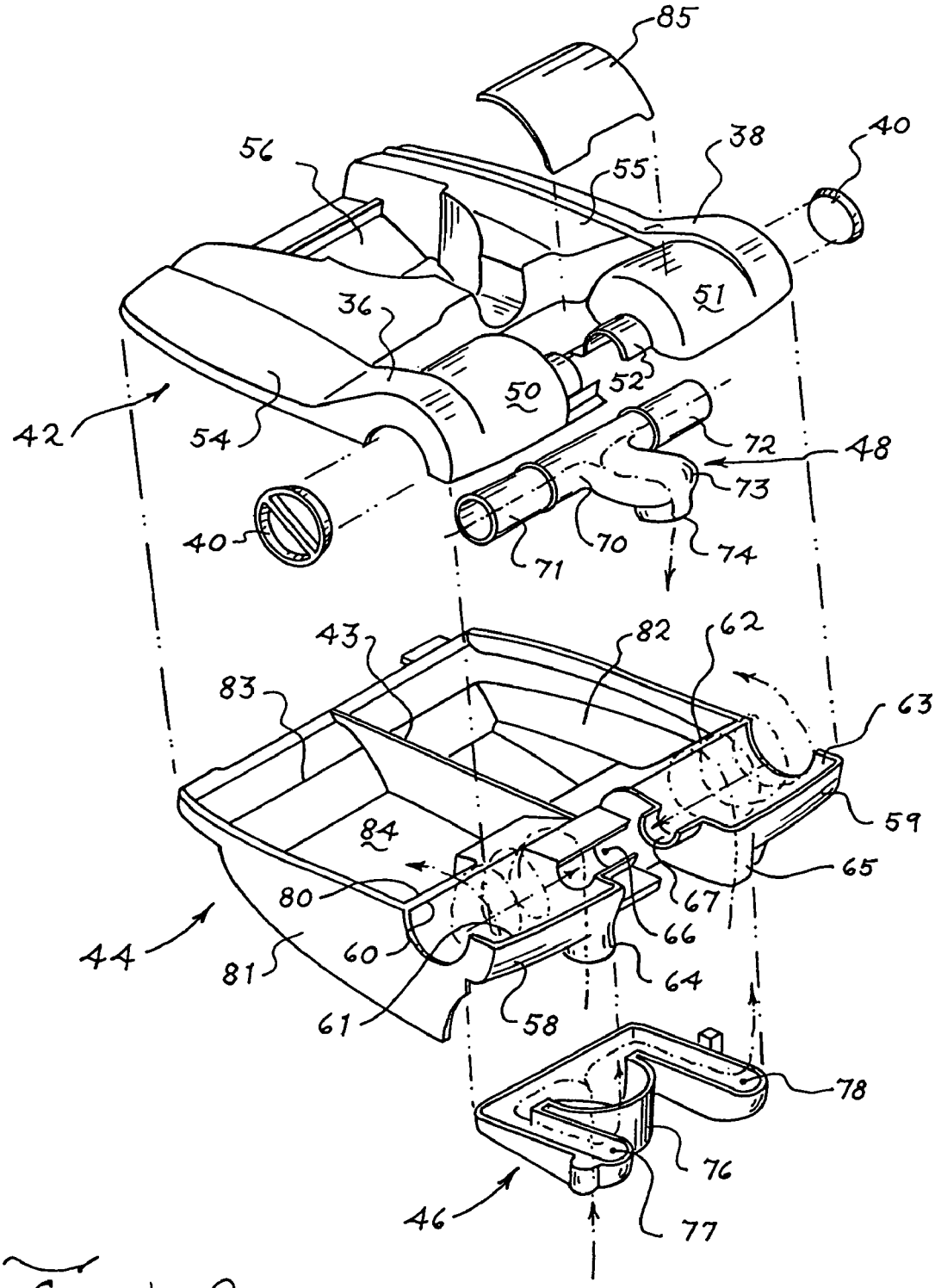
FIG. 2 is an exploded perspective view of the separator and dust collector of the cleaner.

Referring now to FIG. 2 of the drawings, this illustrates in more detail the construction of the separator/collector assembly 12. Its principal components include an upper member 42 and a lower member 44, which are injection mouldings of a suitable plastics material. There is also an inlet member 46 and an outlet member 48 which respectively provide passages for flow of dust-laden air to the separators 30, 32 and for flow of cleaned air from the separators.

The upper member 42 includes respective hollow semi-cylindrical upper cyclone body parts 50, 51, spaced from and in alignment with one another. At their ends which are adjacent to one another, there are end walls leading into semi-cylindrical spigot parts of which that for the part 51 is visible at 52. At the opposite ends of the cyclone body parts 50, 51 the dust outlet passages 36, 38 extend tangentially from the body parts 50, 51, leading into respective parts 54, 55 of the upper member 42. These parts 54, 55 together form the upper cover of a dust collector box and in the upper cover between the parts 54, 55 there is a recess 56 for accommodating a cleaning tool for storage.

The lower member 44 of the separator/collector assembly comprises lower cyclone body parts 58, 59 which are semi-cylindrical and whose lateral edges, as indicated at 60, 61 for the part 58, and 62, 63 for the part 59, meet the corresponding edges of the upper cyclone body parts 50, 51 to define hollow cylindrical cyclone bodies. At the ends of the cyclone body parts 58, 59 adjacent one another, there are defined upwardly extending inlet passages 64, 65 respectively, leading tangentially into the cyclone body parts. At these ends, the cyclone body parts also afford part-cylindrical wall parts of reduced diameter, which wall parts 66, 67 face the half-spigots as 52.

Thus when the members 42, 44 are secured together, e.g. by welding between the facing wall surfaces thereof, they define two cyclone bodies with respective tangential inlet passageways for dust laden air, tangential outlet passages for dust, separated from the air in the cyclone bodies, and the spigots defined by formations 52, 66, 67, which face one another. The members 42, 44 also define a dust collection chamber for the reception and retention of the dust separated by the cyclonic separators. The dust collection chamber is divided by a wall 43, formed by walls in the members 42, 44 when joined together, to prevent the two cyclone bodies communicating via the interior of the dust collection chamber.

The air outlet member 48 is generally T-shaped overall, comprising a straight tubular part 70 whose opposite ends lie between the formations 52, 66, 67 of the cyclone body parts so as to be held therebetween, and beyond the tubular part 70 respective aligned tubular parts 71, 72 reach into the respective cyclone bodies nearly to the removable end plugs thereof. From the centre of the portion 70, a curved tubular portion 73 extends to a downwardly-facing outlet 74. When the separator/collector assembly is in position in the body of the cleaner for use, the outlet 74 engages, with a suitable flexible seal therebetween, the spigot 22 leading to the pre-filter and suction source of the cleaner.

Beneath the cyclone body parts 58, 59 of the member 44 there is secured the inlet member 46. This has a downwardly facing tubular spigot 76 which opens upwardly into a somewhat U-shaped trough-like formation with spaced limbs 77, 78 facing the inlet passages 64, 65 for tangential flow of air into the cyclone bodies. Apart from the vicinity of the inlet passages 64, 65, the top of the trough-like formation is closed by the engagement of the member 46 with the member 44 in the region between the cyclone body parts 58, 59 thereof. The spigot 76 is positioned to engage the outlet 28 from the suction hose and the duct within the body part of the cleaner beneath the recess 11, and to have sealing engagement therewith by use of a suitable sealing element therebetween.

The member 44 further affords a rear wall portion 80, side wall portions 81, 82, a front wall portion 83, and a bottom wall portion 84 which is or includes a portion which is openable when required to empty collected dust. A suitable catch for holding the bottom wall 84 or its openable part closed, together with a release mechanism for enabling it to open when required, would be provided but is not illustrated.

A catch mechanism would also be provided for holding the separator/collector assembly 12 in position on the body 10 of the cleaner, for use. A release mechanism would also be provided to enable it to be removed for emptying when required: such release mechanism may be operated by a member 85 which covers the space between the cyclone bodies 30, 32 and the part of the outlet member 48 which occupies such space. Conveniently the release mechanism provides, once the separator/collector assembly 12 has been released from the body 10, a handle for carrying the separator/collector unit 12.

The flow of air through the separators when in use is shown by arrows on FIG. 2. Air entering the spigot 76 of the inlet member 46 is divided into two, and enters the respective cyclone bodies tangentially. Within the cyclone bodies it swirls helically about their axis, and at the ends of the cyclone bodies which are remote from one another separated dust is thrown off tangentially to enter the respective parts of the dust collector chamber. Air from which such dust has been separated enters the outermost ends of the parts 71, 72 of the outlet member 48, and the two streams of air merge to pass from the outlet 74 to the pre-filter and source of suction of the cleaner. If any large pieces of debris should reach the cyclone bodies and become trapped therein, removal thereof is possible if the end closure plugs 40 are removed from the cyclone bodies.

The invention thus provides an assembly of cyclonic separators and a dust collection chamber which is compact and utilises relatively few separate components. By utilising the principal components of the upper member and lower member 42, 44 which fit together at an interface which extends axially of the two separator bodies 30, 31, parts which constitute the dust collector chamber can be provided as unitary mouldings with the separator bodies.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A cyclonic separator for a suction cleaner, comprising a first cyclone body formed from at least two components that fit together at multiple interfaces extending axially along a longitudinal axis of the first cyclone body, wherein at least part of the interfaces between the first cyclone body components lies in a plane which also contains longitudinal axis of the first cyclone body.

2. A separator according to claim 1 wherein at least one of an air inlet and a dust outlet is formed by the first cyclone body components.

3. A separator according to claim 1 wherein portions of the first cyclone body components are either semi-cylindrical or tapered.

4. A separator according to claim 1 wherein a dust collecting chamber is provided in association with at least one of the first cyclone body components.

5. A separator according to claim 1 wherein at least one of the first cyclone body components includes at least one passage extending transversely through the first cyclone body.

6. A separator according to claim 5 wherein the first cyclone body components define a tangential air inlet passage and a tangential dust-outlet passage.

7. A separator according to claim 6 wherein the inlet passage is at or adjacent a first end of the first cyclone body and the dust outlet passage is at or adjacent a second end of the first cyclone body.

8. A separator according to claim 6 wherein an outlet passage for air leaving the separator is provided by an outlet member extending axially of the separator from the first end of the first cyclone body.

9. A separator according to claim 8 wherein the outlet member extends from the first end of the first cyclone body having the inlet passage.

10. A separator according to claim 9 further comprising a second cyclone body formed from at least two components that fit together at interfaces that lie in a plane which contains an axis of the second cyclone body, wherein the second cyclone body is connected to the first cyclone body.

11. A separator according to claim 10 wherein the second cyclone body includes an air inlet passage at or adjacent a first end of the second cyclone body and a dust outlet passage at or adjacent a second end of the second cyclone body, and an outlet passage for air leaving the separator is provided by an outlet member extending axially of the separator from the first end of the second cyclone body.

12. A cyclonic separator for a suction cleaner, comprising a first cyclone body formed from at least two components that fit together at multiple interfaces extending axially along the first cyclone body; and a second cyclone body formed from at least two components that fit together at interfaces that lie in a plane which contains an axis of the second cyclone body, wherein the first cyclone body is connected to the second cyclone body, wherein the first and second cyclone bodies are arranged in an end-to-end relationship with one another;

wherein the first cyclone body components define a tangential air inlet passage and a tangential dust-outlet passage, wherein the inlet passage is at or adjacent a first end of the first cyclone body and the dust outlet passage is at or adjacent a second end of the first cyclone body, and wherein an outlet passage for air leaving the separator is provided by an outlet member extending axially of the separator from the first end of the first cyclone body having the inlet passage;

wherein the second cyclone body includes an air inlet passage at or adjacent a first end of the second cyclone body and a dust outlet passage at or adjacent a second end of the second cyclone body, and an outlet passage for air leaving the separator is provided by an outlet member extending axially of the separator from the first end of the second cyclone body.

13. A separator according to claim 12 wherein the axis of the first cyclone body and the axis of the second cyclone body are in alignment with one another.

14. A separator according to claim 12 wherein the first and second cyclone bodies are arranged with the air inlet of the first cyclone body and the air inlet of the second cyclone body adjacent to one another, and the dust outlet of the first cyclone body and the dust outlet of the second cyclone are located at the ends of the first and second cyclone bodies that are remote from one another.

15. A separator according to claim 14 further comprising a divided dust collecting chamber connected to both of the dust outlets.

16. A separator according to claim 14 wherein the air outlet member of the first cyclone body and the air outlet member of the second cyclone body comprise a combined air outlet member, the combined air outlet member having a portion extending into the first and the second cyclone bodies in opposite directions from the adjacent ends thereof.

17. A separator according to claim 16 wherein the combined air outlet member is a generally T-shaped pipe, with the oppositely-extending portions thereof connected to an outlet pipe lying between the adjacent ends of the first and second cyclone bodies.

18. A separator according to claim 17 wherein the outlet pipe extends transversely of the axes of the first and second cyclone bodies, for connection to a source of suction in a cleaner.

19. A separator according to claim 15 wherein the first and second cyclone bodies and the divided dust collection chamber are connected to form a unit removeably connected to a suction cleaner body.

20. A cyclonic separator for a suction cleaner, comprising a first cyclone body formed from at least two components that fit together at multiple interfaces extending axially along the first cyclone body, wherein the first cyclone body components define a tangential air inlet passage and a tangential dust outlet passage, wherein the inlet passage is at or adjacent a first end of the first cyclone body and the dust outlet passage is at or adjacent a second end of the first cyclone body, and wherein an outlet passage for air leaving the separator is provided by an outlet member extending axially of the separator from the first end of the first cyclone body having the inlet passage;

a second cyclone body formed from at least two components that fit together at interfaces that lie in a plane which contains an axis of the second cyclone body, wherein the first cyclone body is connected to the second cyclone body; and an inlet member providing a branched passage leading to the air inlet passage of the first cyclone body and the air inlet passage of the second cyclone body.

21. A cyclonic separator for a suction cleaner, comprising a first cyclone body formed from at least two components that fit together at multiple interfaces extending along the longitudinal axis of the first cyclone body, wherein the first cyclone body comprises:

a tangential air inlet passage and a tangential dust outlet passage, wherein the inlet passage is at or adjacent a first end of the first cyclone body and the dust outlet passage is at or adjacent a second end of the first cyclone body; and an outlet passage for air leaving the first cyclone body is provided by an outlet member extending along the longitudinal axis of the first cyclone body, the outlet member having a first and a second end, wherein the first end extends from the first end of the first cyclone body having the inlet passage and the second end is positioned within the first cyclone body at a distance closer to the second end than the first end; and a removable plug attached to the second end of the first cyclone body for debris removal.

22. A separator according to claim 21, further comprising a second cyclone body formed from at least two components that fit together at multiple interfaces extending along the longitudinal axis of the second cyclone body, wherein the second cyclone body comprises:

a tangential air inlet passage and a tangential dust outlet passage, wherein the inlet passage is at or adjacent a first end of the second cyclone body and the dust outlet passage is at or adjacent a second end of the second cyclone body; and an outlet passage for air leaving the second cyclone body is provided by an outlet member extending along the longitudinal axis of the second cyclone body, the outlet member having a first and a second end, wherein the first end extends from the first end of the second cyclone body having the inlet passage and the second end is positioned within the second cyclone body at a distance closer to the second end than the first end; and a removable plug attached to the second end of the second cyclone body for debris removal.

23. A separator according to claim 22 wherein the first and second cyclone bodies are arranged in an end-to-end relationship with one another along their longitudinal axes.

24. A separator according to claim 23 wherein the first and second cyclone bodies are arranged with the air inlet of the first cyclone body and the air inlet of the second cyclone body adjacent to one another, and the dust outlet of the first cyclone body and the dust outlet of the second cyclone are located at the ends of the first and second cyclone bodies that are remote from one another.

25. A separator according to claim 24 further comprising a divided dust collecting chamber connected to the dust outlets of the first and second cyclone bodies.

26. A separator according to claim 24 wherein the air outlet member of the first cyclone body and the air outlet member of the second cyclone body comprise a combined air outlet member, the combined air outlet member having a portion extending into the first and the second cyclone bodies in opposite directions from the adjacent ends thereof.

27. A separator according to claim 26 wherein the combined air outlet member is a generally T-shaped pipe, with the oppositely-extending portions thereof connected to an outlet pipe lying between the adjacent ends of the first and second cyclone bodies.

* * * * *